US007151906B2

(12) United States Patent
Chou et al.

(10) Patent No.: US 7,151,906 B2
(45) Date of Patent: Dec. 19, 2006

(54) LIQUID TONER ELECTROPHOTOGRAPHIC PRINTING SYSTEMS AND METHODS

(75) Inventors: Hsin Hsin Chou, Woodbury, MN (US); Truman F. Kellie, Lakeland, MN (US)

(73) Assignee: Samsung Electronics Co., Ltd., Suwon (KR)

( * ) Notice: Subject to any disclaimer, the term of this patent is extended or adjusted under 35 U.S.C. 154(b) by 45 days.

(21) Appl. No.: 10/978,634

(22) Filed: Oct. 31, 2004

(65) Prior Publication Data

US 2006/0093404 A1 May 4, 2006

(51) Int. Cl.
*G03G 15/10* (2006.01)

(52) U.S. Cl. ..... 399/237; 399/239; 399/249

(58) Field of Classification Search ..... 399/237, 399/239, 240, 249, 348
See application file for complete search history.

(56) References Cited

U.S. PATENT DOCUMENTS 6,640,074 B1 10/2003 Kim
6,701,111 B1 * 3/2004 Park et al. ..... 399/239
6,766,130 B1 7/2004 Song et al.
2003/0156857 A1 8/2003 Kim
2004/0002014 A1 1/2004 Chae et al.

* cited by examiner

*Primary Examiner*—Hoang Ngo
(74) *Attorney, Agent, or Firm*—Kagan Binder, PLLC

(57) ABSTRACT

A liquid developer imaging system comprising a developing container for receiving a quantity of developing solution, a sensing system for maintaining a predetermined processing level of developing solution within the container, a developer roller connected to a first power supply source that biases the developer roller to a development voltage, and a skiving element for plating the developing solution onto the developer roller and scraping excess developing solution from the developer roller to a predetermined thickness, wherein the skiving element is connected to a second power supply source for biasing the skiving element to a skiving voltage, wherein the skiving voltage is greater than the development voltage.

19 Claims, 7 Drawing Sheets

LIQUID TONER ELECTROPHOTOGRAPHIC PRINTING SYSTEMS AND METHODS

TECHNICAL FIELD

The present invention relates to systems and methods for electrophotographic printing using liquid toner materials. More specifically, the electrophotographic printing systems and methods of the present invention relate to systems and methods for providing relatively uniform liquid toner layers to a photoreceptor for image development and transfer to a final image receptor.

BACKGROUND OF THE INVENTION

In a typical liquid developer imaging system, light is scanned onto a photosensitive object, such as a photoreceptor roller, to form an electrostatic latent image corresponding to a desired final image to be printed on a substrate. The obtained electrostatic latent image is developed with a developing solution containing powdered toner and a liquid solvent. The developed image is then transferred or printed onto a piece of paper or other substrate, preferably with an acceptable print quality and density.

One equipment arrangement of a liquid developer imaging system is sometimes referred to as a gap development system, which includes a rotating developer roller that is positioned to be at least partially submerged within a container holding a developing solution or toner. A photoreceptor roller, which is rotating in the opposite direction of the developer roller, is spaced from the developer roller by a specified gap distance. Charged ink particles within the toner are driven first to the developer roller by a deposition roller due to the surface voltage difference provided on the developer roller and deposition roller by voltage sources, then a skiving blade is provided to remove excess toner from the developer roller and prevent backplating. To prevent backplating, the skive roller or blade has to be biased at the same or a higher voltage than that of the deposition roller. It therefore continues to plate the liquid toners carried to the nip between the developer roller and the skive roller or blade. It also squeezes out the excessive liquid toner due to the zero gap depth at the nip. The remaining charged ink particles within the toner on the developer roller are then driven to discharged areas of the photoreceptor roller to create a desired developed image. The developed image may subsequently be transferred to a substrate, such as paper. This type of process can provide a relatively uniform ink layer with precise calibration and adjustment of the surface voltages, transfer speeds, skiving blade location, percent solids of the toner, and the like. In some cases, however, a slight variation of any one of these or other parameters can create an image that is not uniform in density or thickness. This can result in prints that are unacceptable in quality.

Another process that is commonly used for producing a toner layer uses a developer roller that receives liquid ink transferred from another source or device and subsequently transfers the ink to a photoreceptor roller in latent image areas on the surface of the photoreceptor roller. In one arrangement of this kind, the developer roller is in contact with the photoreceptor roller throughout the ink transfer process. The developer roller may also be referred to as a receiving electrode, and is commonly made from an inner core of metal acting as a conductive shaft that is coated with a thick intermediate layer of resilient conductive rubber. The developer roller further may include a relatively thin outer dielectric layer of rubber that is less conductive. One type of source or device that can provide ink to the developer roller may be referred to as a deposition roller or a donating electrode. The deposition roller is commonly a long metal cylindrical roll that is parallel to and placed near the developer roller, with a slight gap between the surfaces of the developer roller and deposition roller, such as approximately 0.008 inches (0.203 mm), for example. The small space between the developer roller and the deposition roller may be referred to as the developer gap.

In this process, the deposition roller is at least partially submerged in a container that is holding the developing solution or toner. The developer roller is also partially submerged in the developing solution in the container. The deposition roller then plates toner onto the developer roller electrophoretically through a carefully set gap between the developer roller and the deposition roller. That is, specific voltages are applied to both the developer roller and the deposition roller by a developer roller power source and a deposition roller power source, respectively. These surface voltages may be referred to as bias voltages. The bias voltage on the deposition roller (e.g., 700 volts) is made to be greater than the bias voltage on the developer roller (e.g., 500 volts) to generate an electrical field across the developer gap in the presence of the unequal voltages. In this way, positively charged ink particles within the developer gap are forced onto the surface of the developer roller. This process may further include a skiving element that is used subsequent to the plating of ink particles onto the surface of the developer roller. The skiving element may be in form of a roller or blade that is pressed against the developer roller to squeeze excess liquid ink carrier solvent from the surface of the ink layer that has been plated onto the surface of the developer roller, thereby accelerating the image-drying process. This action of the skiving element helps to increase the percent of solids (i.e., the solids content) of the plated ink layer and to provide a more uniform ink layer thickness.

In some processes that use a skiving element as described above, biasing the deposition roller and the skiving element to the same voltage while holding the developer roller to a lesser voltage can help to maintain the uniformity of the thickness and density of an ink layer. One example of such a process is described in U.S. Patent Publication No. 2003/0044202, which is commonly owned by the assignee of the present invention, the entire contents of which are incorporated herein by reference. With these types of processes, however, the uniformity of the ink layer depends upon maintaining precise control over several electrostatic characteristics of the ink being plated such as conductivity, charge-per-mass ratio, charge retention time, particle size, and the like. In cases where the deposition roller voltage and the skiving element voltage are equal it can be difficult to obtain a uniform ink layer on the developer roller when the ink conductivity is too low, for example. This is due to the relatively low strength of the electrostatic forces in the skiving nip that make it more difficult for the ink particles to be held against the developer roller, particularly in the presence of fluid forces that tend to work against the relatively low electrostatic forces.

In cases where electrostatic forces are not high enough to keep the ink particles highly and consistently attracted to the developer roller, the ink layer produced on the surface of a developer roller can be non-uniform in thickness and/or density, which can translate to a pattern in the printed image that is visible to the human eye. This irregular pattern in the image may be referred to as a "flow pattern" in the printed image. While such flow patterns do not always occur, the quality of an ink layer of the developer roller in this process may also vary from acceptable quality to unacceptable quality depending on the chemistry of the final ink. For example, yellow and magenta inks may not exhibit a flow pattern on the developer roller in the same process where cyan and black do show a flow pattern. Thus, it is desirable to provide a process and system of liquid developer imaging that limits the effects of small variations in ink properties or other parameters on the quality of the ink layer that is plated onto the developer roller.

SUMMARY OF THE INVENTION

The liquid toner electrophotographic printing systems and methods of the present invention are designed to generate high quality prints that are free from unwanted patterns in printed areas, which are typically caused by certain flows of the liquid ink during printing. In other words, prints produced using the methods and systems of the present invention can be considered to have minimal to no "flow patterns". This is at least partially accomplished in a liquid toner developer imaging system of the present invention by maintaining at least one toner layer on a developer roller that is relatively smooth, uniform in thickness, and void of measurable or observable patterns, which toner layer or layers can then be transferred to another substrate to make a print. Controlling certain device voltages and voltage differentials between devices in the methods and systems of the present invention will provide for such improvements in the toner layers. In accordance with the systems present invention, it has been found that it can be more feasible to control the behavior of liquid toner through the control of measurable voltage differentials than through attempts to maintain tight controls over toner formulations and ink conductivity, as in prior art systems. In other words, the significant differences in the thickness and density of the ink layers plated onto a developer roller caused by small variations in ink properties can be minimized or eliminated by using the systems and methods of the present invention, which are more accommodating to ink variability. In one aspect of the invention, a developer roller and a deposit roller of a printing system are connected to the same voltage source, while a higher voltage is applied to a skiving element. Such a skiving element may be, for example, a conductive rolling cylinder that is in contact with and rotating in the same surface direction as a compliant developer roller, or may be a conductive blade that is in contact with and sliding across the surface of a compliant developer roller.

The present invention further provides methods and systems that advantageously decrease and/or minimize the number of power sources used, thereby simplifying the printer construction, saving space within the printing system, and reducing the printer costs. Alternatively, a printing system of the invention may include a deposition roller that is not connected to a voltage source. Another alternative printing system of the invention does not include a deposition roller, which thereby redefines the developer nip of such a printing system to be the skiving nip.

In particular, one aspect of the present invention includes a liquid developer imaging system comprising a developing container for receiving a quantity of developing solution, a sensing system for maintaining a predetermined processing level of developing solution within the developing container, and a developer roller connected to a first power supply source through a voltage-regulating device for biasing the developer roller to a development voltage, wherein the developer roller is positioned to be at least partially submerged in the developing solution at the predetermined processing level. The imaging system further includes a skiving element for plating the developing solution onto the developer roller and scraping excess developing solution from the developer roller to a predetermined thickness, wherein the skiving element is connected to the first power supply source for biasing the skiving element to a skiving voltage, wherein the skiving voltage is greater than the development voltage. The voltage-regulating device may be a diode, such as a zener diode, for example.

Another alternative of the present invention includes a liquid developer imaging system comprising a developing container for receiving a quantity of developing solution, a sensing system for maintaining a predetermined processing level of developing solution within the developing container, and a developer roller connected to a first power supply source that biases the developer roller to a development voltage, wherein the developer roller is positioned to be at least partially submerged in the developing solution at the predetermined processing level. The imaging system further comprises a skiving element for plating the developing solution onto the developer roller and scraping excess developing solution from the developer roller to a predetermined thickness, wherein the skiving element is connected to a second power supply source for biasing the skiving element to a skiving voltage, wherein the skiving voltage is greater than the development voltage. The system may further include a deposit roller connected to the first power supply source for biasing the deposit roller to a deposition voltage. The deposition voltage and the development voltage may be the same, or at least one of the deposition roller and the deposit roller may be electrically connected to the first power supply source through a voltage-regulating device for biasing the deposition voltage to be higher than the development voltage. In addition, the deposition voltage may be lower than the skiving voltage.

Another alternative of the previously described system includes a system where the deposit roller is instead connected to the second power supply source for biasing the deposit roller to a deposition voltage. The deposit roller may be connected to the second power supply source through a voltage-regulating device for biasing the deposition voltage to be lower than the skiving voltage.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Figure 1:
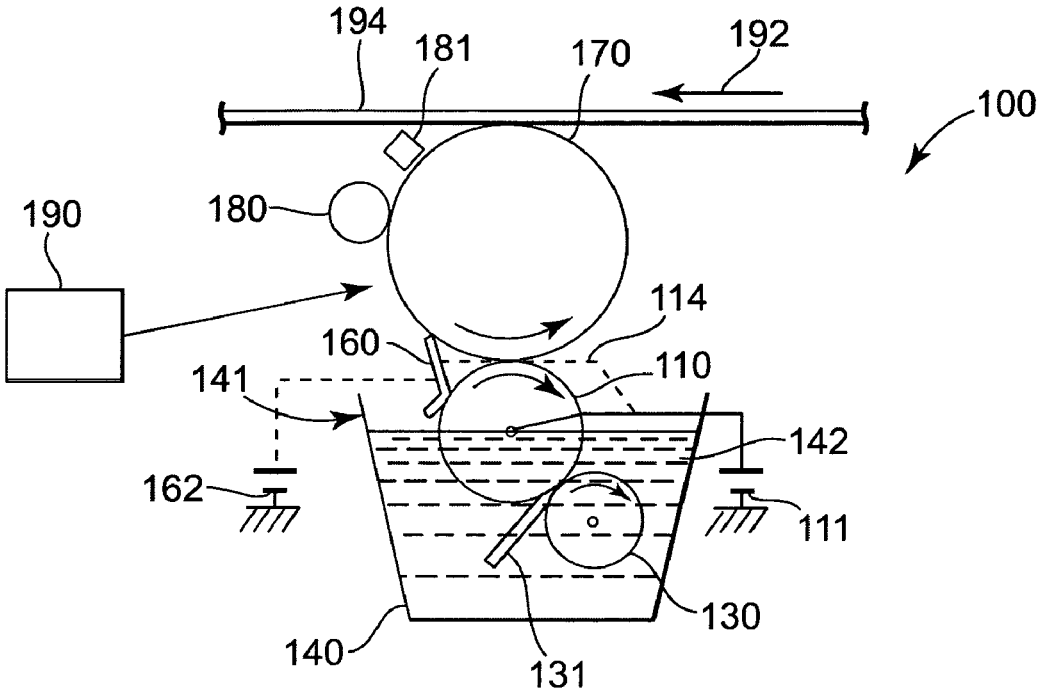
FIG. 1 is a schematic view of one embodiment of a liquid developer imaging system in accordance with the present invention that does not utilize a deposition roller, but instead includes a skiving element connected to a voltage source for image development on a developer roller.

Referring now to the Figures, wherein like components are labeled with like numerals throughout the several Figures, and initially to FIG. 1, one preferred configuration of a liquid developer imaging system 100 is shown. In general, the system 100 includes a developing container 140 for holding a developing solution 142. The developing solution 142 may be supplied to the container 140 by any controllable liquid supply systems and devices that can maintain a desired quantity of liquid 142 in the container 140 during the imaging process. For one example, a cartridge can be provided (not shown) that holds a high-density solution of approximately 3% to 40% solids. This solution is periodically or continuously provided to the container 140 to keep the level of liquid 142 generally constant at a predetermined processing level. This fluid level generally corresponds to the volume of fluid necessary for operation of the imaging system. One way of measuring and maintaining the level of the liquid 142 in the container 140 is with the use of a level sensor 141 that provides data to a liquid supply control system (not shown) for calculation of any necessary changes to be made to the fluid level. It is understood that more than one fluid may be provided to the container 140, such as a dilution liquid with its own supply system, and that many other liquid processing systems and devices may be used prior to a liquid solution entering the container 140, such as mixers, pumps, valves, and the like.

The imaging system 100 preferably includes processing devices positioned within the container 140 that move the developing fluid 142 from the container 140, thereby depleting a portion of the fluid during each print development sequence. In this embodiment, a developer roller 110 is included in the system 100, which is rotating in a clockwise direction and is at least partially submerged in the fluid 142. The system 100 further includes a photoreceptor 170, which is shown in this embodiment as a roller, but may instead include another photoreceptor configuration, such as a belt. The photoreceptor 170 rotates in a direction that is opposite the direction that the developer roller is rotating, which in this case is in a counterclockwise direction. The photoreceptor 170 is also positioned with its axis generally parallel to the axis of the developer roller 110. Generally, due to the surface tension of the ink, some liquid ink is carried by the developer roller 110 toward the nip area generally created where the developer roller 110 and the photoreceptor 170 are closest to each other. The amount of liquid toner carried toward the nip area depends on factors such as the surface tension, the viscosity of the ink, the velocity of the roller rotation, and the distance of the skive nip area from the surface of the liquid toner in the container, for example. Because any one of these factors or the combination of these factors can vary during processing, the fluid thickness can be relatively difficult to accurately control during the deposition process. The system 100 thus preferably further includes a skiving device 160 for controlling the thickness of fluid on the surface of the developer roller 110 during the imaging process and for plating liquid toner onto the developer roller. The skiving element 160, which may be a metering blade, is used for scraping the excess developing solution that is deposited on the surface of the developer roller 110 off of the surface of the developer roller 110 to achieve a predetermined thickness of developing solution. Thus, controlling the position and orientation of the skiving element 160 can help to provide a layer of fluid 142 of uniform thickness on the developer roller 110.

As shown in FIG. 1, skiving element 160 is an L-shaped plate configured so that a portion of the element 160 near the corner is in contact with the developer roller 110 and the legs of the element 160 extend away from the roller 160 at an approximate 90 degree angle from each other. However, the shape of the skiving element 160 is not limited to this configuration and may be shaped and positioned in any way that allows the skiving element 160 to apply sufficient pressure to remove excess developing solution from the surface of the developer roller 110. For example, the skive element could instead be a cylindrical roller positioned at a specific distance from the developer roller 110 or in contact with the developer roller 110 to remove excess developing solution with a pressure or wringing motion. Because the use of the skiving element 160 can also change the concentration of the developing solution on the developer roller 110, the design and selection of a skiving element with certain parameters (e.g., applied pressure, position, voltage, size, shape, and the like) can provide significant advantages to achieving a relatively uniform toner layer on the developer roller 110.

The developer roller 110 may also be referred to as a receiving electrode, which may be comprised of a single material or several layers of material. For one example, the developer roller 110 may be made from an inner core of metal acting as a conductive shaft that is coated with a thick intermediate layer of resilient conductive rubber. The developer roller 110 may further include a relatively thin outer dielectric layer of rubber that is less conductive. The overall parameters of the developing roller 110 may include a roller that is a conductive elastomer formed of polyurethane or nitrile-butadiene rubber, having a resistance between approximately $10^5$ and $10^8$ ohms, a hardness of about 25–26 degrees Shore A, and a surface roughness of about Ra 1–4 μm.

The imaging system 100 further includes a charging roller 180 or other charging device for electrically charging the surface of the photoreceptor roller 170 to a relatively uniform charge in preparation for the receipt of an image. Before the charging roller 180 electrically charges the photoreceptor 170, however, a device such as electrostatic potential reset unit 181 can be used to erase or reset the electrostatic charge of the surface of the photoreceptor 170 to a uniform value. The system 100 further includes an optical scanning device 190 that is used for scanning radiation in the form of the desired image onto the photoreceptor 170 to form an electrostatic image on its surface. The device 190 may be any of a number of known optical scanning systems that translate information received from another source to a signal for applying a particular amount of radiation in a particular pattern or design onto the photoreceptor 170.

Developer roller 110 is connected to a power supply source 111 that is used for applying a development voltage to the developer roller 110. When an image is developed on the photoreceptor 170 using the methods and systems described herein, the developed image may subsequently be transferred to a belt 194, which is particularly designed to receive one or more images that can then be transferred to paper or some other final substrate. As shown, the belt 194 is moving in a direction 192 that corresponds with the surface direction of the photoreceptor 170 as its surface with the developed image moves into contact with the belt 194. The developed image on the photoreceptor 170 may instead be transferred to another type of element besides a belt, however, depending on the exact configuration of the printer and any assisted imaging systems. For example, the developed image may be transferred to a roller that can optionally receive images from multiple imaging systems (e.g., image systems similar to system 100 and providing other colors) before transfer of a final image to a substrate. In yet another alternative, the developed image on the photoreceptor 170 may be directly transferred to a final substrate, such as paper, without any intermediate transfer members.

In one preferred embodiment of the invention, illustrated in FIG. 1, the skiving element 160 is connected to a power supply source 162 that provides a skiving voltage to the skiving element 160. As shown, this embodiment does not include a deposition roller or other devices for depositing developing solution on the developer roller 110. Rather, because this arrangement does not include plating of ink in a nip between a developer roller and a deposition roller, development of each image occurs in the nip where the skiving element 160 contacts the developer roller 110. To achieve high quality printing with this arrangement, the bias voltage of the skiving element should be greater than the total bias voltage of the developer roller plus the voltage of the ink layer provided thereon. In addition, it is important for the system to include adequate methods for delivering sufficient liquid ink to the gap or nip between the developer roller 110 and the skiving element 160. Inadequate liquid ink delivery into this area can result in lower image density in the toner layer and final prints.

The power supply source 162 is shown as being connected to the skiving element 160 with dashed lines in FIG. 1 because an alternative arrangement of the present invention includes connecting the skiving element 160 instead being connected to the power supply source 111 that is also electrically connected to the developer roller 110, as is indicated with dashed lines 114. In this arrangement, only one power supply (power supply 111) and one skiving element 160 are used to both develop the ink layer and to squeeze the ink layer on the developer roller to reduce the solvent content. The power supply 162 would thus be unnecessary for operation of this configuration of the system 100. This arrangement would require a zener diode, within the electrical connection between the power supply source 111 and the developer roller 110. This zener diode is used to lower the single applied voltage of the power supply source 111 to the desired bias voltage for the developer roller. Thus, the choice of a zener diode for a particular system of this type will depend on the desired differential between the bias voltage of the skiving element and the bias voltage of the developer roller plus the ink layer voltage, where the desired differential can be determined through predetermined parameters that can be calculated using experimentation and empirical data regarding ink performance.

Whether the skiving element 160 is connected to its own power supply source 162 or connected to the power supply source 111 (with an associated zener diode to provide for a voltage drop for the developer roller), the imaging system 100 is used to plate ink particles onto the developer roller 110 with the use of the element 160 rather than with the use of a deposition roller. The skiving element 160 of this configuration is thus used to develop ink onto the developer roller 110 and immediately squeeze out excess liquid from the developed ink layer. The plated toner layer thickness on the developer roller 110 will correspond with the bias difference between the skiving element 160 and the developer roller 110, while the surface of the plated ink layer on the developer roller 110 can be made to be relatively smooth and free of flow patterns at certain bias differences. That is, particular target bias voltage differences between the skiving element 160 and the developer roller 110 can be determined that will produce certain desired or target ink densities in the finished prints. The imaging system 100 can thus provide a uniformly thick layer of ink on the developer roller 110 that allows for the production of high quality prints that are free from unwanted patterns in the printed areas. This high quality can be maintained through the movement of ink particles from the developer roller and through the printing system and onto the final image receptor (e.g., paper) without creating undesirable patterns in the ink at any subsequent interfaces in the system. Thus, controlling the delivery of sufficient ink to the contact point between the developer roller 110 and the skiving element 160 is important for achieving the high quality prints that can be available by using the imaging system 100 of the present invention.

The imaging system 100 preferably will further include a system or device for cleaning any remaining ink from the surface of developer roller 110 after a developed image is transferred from the surface of the developer roller 110. One such system can include a cleaning roller 130 that is in contact with the developer roller 110 and that preferably rotates in the same direction as the developing roller 110 so that the surfaces of the two rollers are moving opposite one another. The cleaning system can further include a cleaning blade 131 or other apparatus, one end of which is also positioned to be in contact with the surface of the developing roller 110. The relatively stationary position of the cleaning blade 131 cooperates with the rotation of the cleaning roller 130 to remove particles of toner of the developing solution 142 that remain on the developer roller 110 after the completion of each printing cycle (i.e., after a developed image has been transferred from the photoreceptor 170 to another substrate, such as the intermediate belt 194). Any number of different cleaning systems or devices can be used to perform such a cleaning of the developer roller 110 instead of, or in addition to the roller/blade configuration described above, such as, for example, other conformable roller and/or blade combinations that include one or more components.

Developing images using the imaging system 100 described above involves a series of steps, which include supplying developing solution 142 to the developing container 140 to be within a predetermined fluid level range that corresponds with certain desirable operating parameters of the system. That is, the quality of the prints produced by the system 100 can be at least partially controlled by keeping the level of the developing solution 142 within a certain operating range. Thus, a system for measuring and maintaining this fluid level is preferably used to maintain the fluid level within the operating range for multiple subsequent print cycles. Bias voltages may then be applied to the developer roller 110 and the skiving element 160, where the applied voltages are particularly chosen so that the bias voltage of the skiving element 160 will be larger than the sum of the bias voltage of the developer roller 110 and the voltage of an ink layer that will be coated on the surface thereof. As described above, a zener diode or other voltage-regulating device may be used to drop the voltage of the developer roller 110 in cases where the developer roller 110 and the skiving element 160 are connected to the same power source.

After the application of the bias voltages, particles of the positively charged toner included in the developing solution 142 will be attracted to the surface of the developer roller due to the charge differential between the bias voltages of the skiving element 160 and the developer roller 110. At this point, the electrically plated ink particles will be electrically "attached" to the surface of the developer roller 110. As the developer roller 110 rotates, skiving element 160 is used to squeeze excess liquid from the toner layer and to plate additional ink on the developer roller surface. The toner layer will then rotate into contact with the photoreceptor 170 for development of a latent image that has been provided on the surface of the photoreceptor 170 by the optical scanning device 190. The developed image may subsequently be transferred to a belt 194, which is particularly designed to receive one or more images that can then be transferred to paper or some other final substrate. During this process, the cleaning roller 130 may be used to remove toner particles remaining on the developer roller 110.

The imaging systems of the present invention, such as system 100 described above, can typically only develop a single color image for transfer to a substrate. Thus, for prints that require multiple colors (e.g., four color systems that use yellow, magenta, cyan and black inks), one imaging system would be provided for each color within a larger printing system. The multiple colors may overlap each other and/or be adjacent to one another in each particular print, as desired. To form a complete toned image for such multiple color systems, each system can sequentially transfer a developed image to a substrate as the substrate moves past it. Alternatively, one or more imaging systems (or components thereof) may move relative to a generally or completely stationary substrate.

Figure 2:
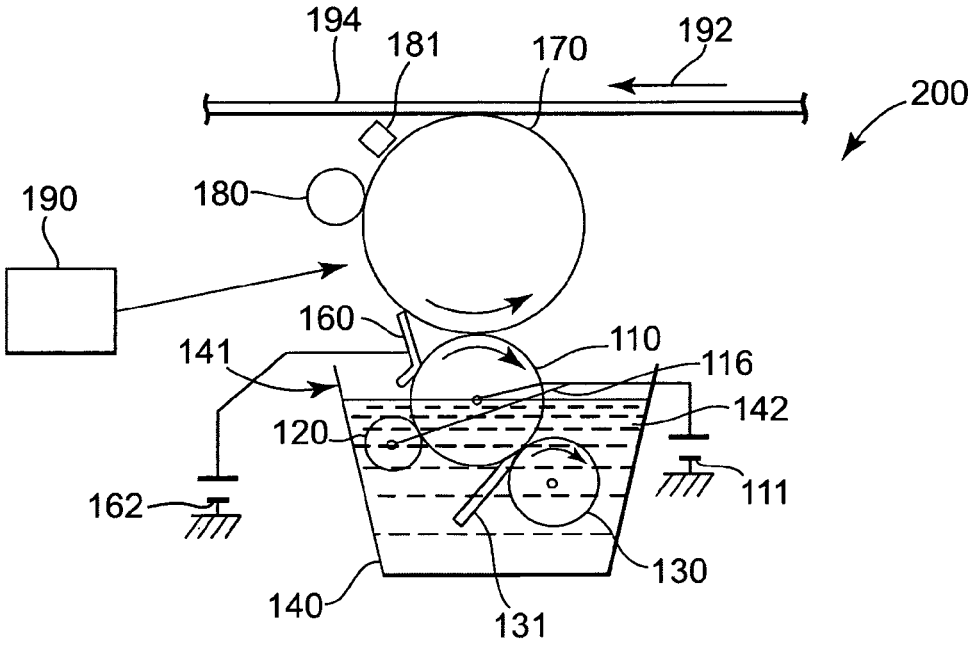
FIG. 2 is a schematic view of another embodiment of a liquid developer imaging system in accordance with the present invention that includes a developer roller and a deposition roller connected to a common voltage source and a skiving element connected to a separate voltage source.

Another embodiment of an imaging system 200 is illustrated in FIG. 2, in accordance with the present invention. This system is similar to that of FIG. 1, but system 200 further includes a deposition roller 120, which may be referred to as a donating electrode, that is used for providing ink to the developer roller 110 prior to contact between the ink layer and the skiving element 160. The deposition roller 120 is commonly a long metal cylindrical roll (e.g., stainless steel) that is parallel to and placed near the developer roller 110, preferably with a slight gap between the surfaces of the developer roller 110 and deposition roller 120, such as approximately 0.008 inches (0.203 mm), for example. This small space between the developer roller 110 and the deposition roller 120 may be referred to as the developer gap. The deposition roller 120 may be a roller that is fixed in position or that rotates, or may alternatively have another configuration, such as a plate having the same or a similar curvature to that of the developer roller 110.

In this embodiment, the deposition roller 120 is connected to the same power supply source 111 as the developer roller 110 (as indicated by line 116) so that if the system is not provided with any additional voltage control mechanisms, both the deposition roller 120 and the developer roller 110 will receive the same applied voltage by the power supply source 111. With this configuration, there is no differential between the voltages on the developer roller 110 and the deposition roller 120, so no ink will be plated in the nip or gap between the developer roller 110 and the deposition roller 120. In order to develop an image on the developer roller 110, the power supply source 162 will provide a skiving voltage to the skiving element 160 that is greater than the bias voltage of the developer roller plus the voltage of any ink layer provided thereon. With these voltages, the system 200 thus operates similarly to that of system 100 of FIG. 1, which does not include a separate deposition roller or other device for depositing developing solution on the developer roller 110. The skiving element 160 of the imaging system 200 is thus used to develop ink into a uniform layer on the developer roller 110 and then immediately squeeze out excess liquid from the developed ink layer. The plated toner layer thickness on the developer roller 110 will correspond with the bias difference between the skiving element 160 and the developer roller 110 in such a way that an operating bias difference can be chosen to correspond with a desired toner layer thickness. This configuration may be particularly applicable for retrofitting existing imaging systems to utilize the methods and systems of the present invention, while minimizing the disassembly and reconfiguration of the imaging system components. That is, the operation of the imaging system 100 is essentially the same as the operation of the imaging system 200 when the developer roller 110 and deposition roller 120 are provided with the same voltage.

As an alternative use of the system described relative to FIG. 2, this configuration that includes the developer roller 110 and deposition roller 120 connected to the same power source may include the use of a zener diode or other voltage-regulating device to change the voltage received by at least one of these rollers from the common power supply source 111. In this way, the bias voltage of the deposition roller 120 can be made slightly higher than the bias voltage of the developer roller 110, for example, but less than the bias voltage of the skiving element 160, which will cause a thin layer of ink to be plated onto the developer roller 110 in the nip or gap between the developer roller 110 and the deposition roller 120. Additional ink can then be plated onto the developer roller 110 in the nip between the skiving element 160 and the developer roller 110. The quantity of additional ink provided in the area of the skiving element 160 should be sufficient to achieve a desired ink density on the developer roller 110. The thin initial layer of ink provided by the deposition roller 120 may make it easier to insure that there is enough ink present in the nip between the skiving element 160 and the developer roller 110 to achieve and maintain adequate print density, even in the presence of decreasing liquid ink solids caused by the printing process. It is contemplated that additional or alternative configurations of deposition devices may included within the imaging system 200 to plate one or more thin layers of ink on the developer roller 110 before the ink layer reaches the skiving element 160.

Figure 3:
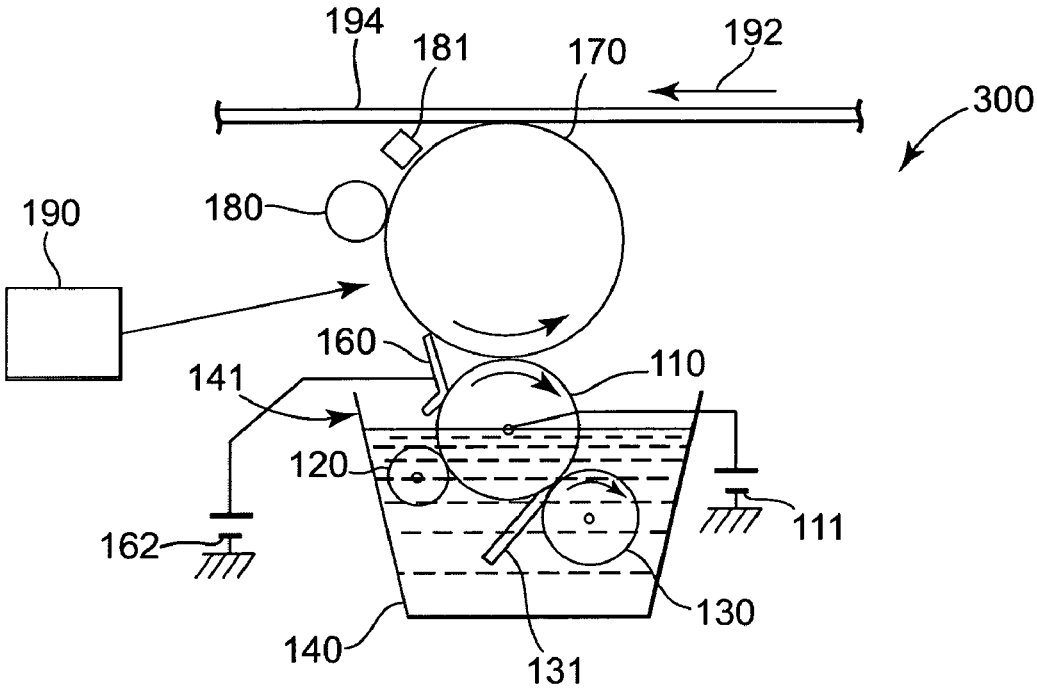
FIG. 3 is a schematic view of another embodiment of a liquid developer imaging system in accordance with the present invention that includes a deposition roller that is not connected to a voltage source.

Another embodiment of an imaging system 300 is illustrated in FIG. 3, in accordance with the present invention. This system is similar to that of FIG. 2, except that system 300 includes a deposition roller 120 that is not connected to a voltage source. In other words, the deposition roller 120 is disconnected from all power supply or voltage sources so that the deposition roller 120 is essentially "floating" electrically. The developer roller 110 is connected to its own power supply source 111. Without any voltage being supplied to the deposition roller 120, no ink will be plated onto the developer roller 110 in the nip or gap between the developer roller 110 and the deposition roller 120, whether or not the developer roller surface is charged. In order to develop a uniform layer of toner on the developer roller 110, the power supply source 162 will provide a skiving voltage to the skiving element 160 that is greater than the bias voltage of the developer roller plus the voltage of the ink layer provided thereon. The skiving element 160 of this configuration is thus used to develop ink onto the developer roller 110 and immediately squeeze out excess liquid from the developed ink layer.

The configuration of FIG. 3 may be particularly applicable for retrofitting existing imaging systems for the methods and systems of the present invention while minimizing the disassembly and reconfiguration of the imaging system components. That is, the operation of the imaging system 300 is essentially the same as the operation of the imaging system 200 when the rollers 110, 120 are provided with the same voltage or essentially the same as the operation of the imaging system 100, which does not include a deposition roller. However, the presence of a deposition roller 120 in system 300 will not typically provide any significant advantages or disadvantages to the print quality within the system 300.

Figure 4:
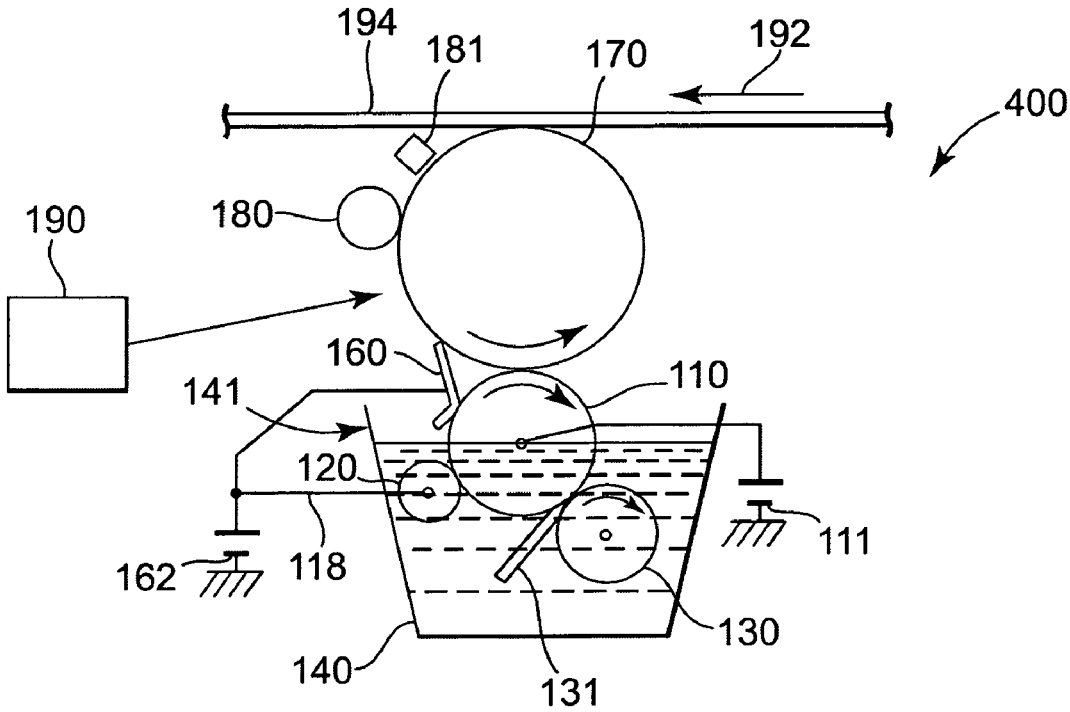
FIG. 4 is a schematic view of another embodiment of a liquid developer imaging system in accordance with the present invention that includes a deposition roller and a skiving element connected to a common voltage source and a developer roller connected to another voltage source.

FIG. 4 illustrates yet another embodiment of a liquid developer imaging system 400 in accordance with the present invention. This system 400 includes many of the same components arranged similarly to the systems of FIGS. 1–3; however, the deposition roller 120 and the skiving element 160 of this embodiment are connected to a common power supply source 162 (with the connection of the power supply source 162 to the deposition roller 120 indicated by line 118), while the developer roller 110 is connected to a separate power supply source 111. System 400 further may include a zener diode (not shown) to cause the voltage provided by the power supply source 162 to drop before it reaches the deposition roller 120. In this way, bias voltage of the deposition roller will be less than the voltage of the skiving element 160, but may be made either equal to or greater than the bias voltage of the developer roller 110. If the bias voltage of the developer roller 110 is made to be roughly equal to the bias voltage of the deposition roller 120, the deposition roller will essentially perform no function and the skiving element 160 will then provide the function of both developing ink onto the developer roller 110 and immediately squeezing out any excess liquid from the developed ink layer. However, if the bias voltage of the deposition roller is made to be slightly higher than the bias voltage of the developer roller 110, but less than the bias voltage of the skiving element 160, a thin layer of ink can be plated onto the developer roller 110 in the nip or gap between the developer roller 110 and the deposition roller 120. Additional ink can then be plated onto the developer roller 110 in the nip between the skiving element 160 and the developer roller 110. The thin initial layer of ink provided by the deposition roller 120 may make it easier to insure that there is enough ink provided to the nip between the skiving element 160 and the developer roller 110 to achieve and maintain adequate print density, even in the presence of potential decreasing liquid ink solids caused by the printing process.

Figure 5:
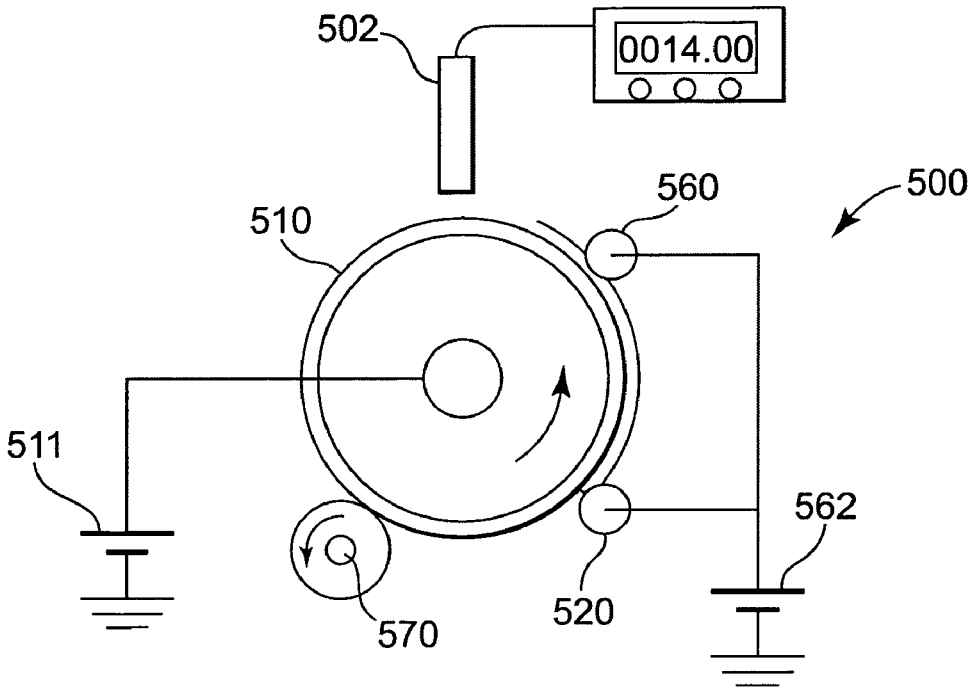
FIG. 5 is a schematic view of an embodiment of a liquid developer imaging system in accordance with the present invention that includes a system for measuring the voltage of a toner layer on a developer roller.

FIG. 5 is an embodiment of a liquid developer imaging system 500 in accordance with the present invention that includes a system for measuring the voltage of a toner layer on a developer roller 510. Imaging system 500 generally includes a developer roller 510 connected to a power supply source 511, a deposition roller 520 and a skiving element 560 connected to a power supply source 562, an electrostatic voltage probe 502, and a cleaning roller 570. As shown, the voltage probe 502 is positioned in a location where it is relatively convenient to measure the voltage of a toner layer on the developer roller 510 (i.e., the probe 502 does not obstruct the equipment used for the printing process). However, because the voltage at the entrance to the skive nip is the measurement that is needed, calculations using the value taken by the probe 502 can then be made to determine that skive nip voltage. That is, the charge retention time, also known as the toner charge decay time, of the ink being plated, along with the time elapsed from when the toner layer passes through the skive nip until it reaches the probe, can be used in conjunction with the voltage measurement taken by the probe to determine the toner layer voltage at the entrance to the skive nip.

While the above description refers to various arrangements of power sources connected to different components of an imaging system for developing images, it is contemplated that other arrangements may be used to achieve the particular voltage differentials between devices described above, such as providing separate power supplies for each component that requires voltage (although this may be more costly and may require more space) or providing a single power source for all components within a system that require voltage. If such a single power source is provided, zener diodes and/or other voltage control devices may be used to achieve and maintain certain voltage levels for each device.

The operation of the present invention will be further described with regard to the following detailed examples. These examples are offered to further illustrate the various specific and preferred embodiments and techniques. It should be understood, however, that many variations and modifications may be made while remaining within the scope of the present invention.

EXAMPLES

Test Methods and Apparatus

Percent Solids

In the following toner composition examples, percent solids of the graft stabilizer solutions and the organosol and liquid toner dispersions were determined thermo-gravimetrically by drying in an aluminum weighing pan an originally-weighed sample at 160° C. for two hours for graft stabilizer, three hours for organosol, and two hours for liquid toner dispersions, weighing the dried sample, and calculating the percentage ratio of the dried sample weight to the original sample weight, after accounting for the weight of the aluminum weighing pan. Approximately two grams of sample were used in each determination of percent solids using this thermo-gravimetric method.

Molecular Weight

In the practice of the invention, molecular weight is normally expressed in terms of the weight average molecular weight, while molecular weight polydispersity is given by the ratio of the weight average molecular weight to the number average molecular weight. Molecular weight parameters were determined with gel permeation chromatography (GPC) using a Hewlett Packard Series II 1190 Liquid Chromatograph made by Agilent Industries (formerly Hewlett Packard, Palo Alto, Calif.) (using software HPLC Chemstation Rev A.02.02 1991–1993 395). Tetrahydrofuran was used as the carrier solvent. The three columns used in the Liquid Chromatograph were Jordi Gel Columns (DVB 1000A, and DVB10000A and DVB100000A; Jordi Associates, Inc., Bellingham, Mass.). Absolute weight average molecular weight were determined using a Dawn DSP-F light scattering detector (software by Astra v.4.73.04 1994–1999) (Wyatt Technology Corp., Santa Barbara, Calif.), while polydispersity was evaluated by ratioing the measured weight average molecular weight to a value of number average molecular weight determined with an Optilab DSP Interferometric refractometer detector (Wyatt Technology Corp., Santa Barbara, Calif.).

Particle Size

The organosol (and liquid ink) particle size distributions were determined using a Horiba LA-920 laser diffraction particle size analyzer (commercially obtained from Horiba Instruments, Inc, Irvine, Calif.) using Norpar™ 12 fluid that contains 0.1% Aerosol OT (dioctyl sodium sulfosuccinate, sodium salt, Fisher Scientific, Fairlawn, N.J.) surfactant.

Prior to the measurements, samples were pre-diluted to approximately 1% by the solvent (i.e., Norpar™ 12). Liquid toner samples are were sonicated for 6 minutes in a Probe VirSonic sonicator (Model-550 by The VirTis Company, Inc., Gardiner, N.Y.). Dry toner samples were sonicated in water for 20 seconds using a Direct Tip Probe VirSonic sonicator (Model-600 by The VirTis Company, Inc., Gardiner, N.Y.). In both procedures, the samples were diluted by approximately 1/500 by volume prior to sonication. Sonication on the Horiba LA-920 was operated at 150 watts and 20 kHz. The particle size was expressed on a number-average basis in order to provide an indication of dominance of the fundamental (primary) particle size of the particles or was expressed on a volume-average basis in order to provide an indication of dominance of the coalesced primary particle aggregate size of the particles.

Glass Transition Temperature

Thermal transition data for synthesized TM was collected using a TA Instruments Model 2929 Differential Scanning Calorimeter (DSC) (New Castle, Del.) equipped with a DSC refrigerated cooling system (−70° C. minimum temperature limit), and dry helium and nitrogen exchange gases. The calorimeter ran on a Thermal Analyst 2100 workstation with version 8.10B software. An empty aluminium pan was used as the reference. The samples were prepared by placing 6.0 to 12.0 mg of the experimental material into an aluminum sample pan and crimping the upper lid to produce a hermetically sealed sample for DSC testing. The results were normalized on a per mass basis. Each sample was evaluated using 10° C./min heating and cooling rates with a 5–10 min isothermal bath at the end of each heating or cooling ramp. The experimental materials were heated five times: the first heat ramp removes the previous thermal history of the sample and replaces it with the 10° C./min cooling treatment and subsequent heat ramps are used to obtain a stable glass transition temperature value—values are reported from either the third or fourth heat ramp.

Conductivity

The liquid toner conductivity (bulk conductivity, $k_b$) was determined at approximately 18 Hz using a Scientifica Model 627 conductivity meter (Scientifica Instruments, Inc., Princeton, N.J.). In addition, the free (liquid dispersant) phase conductivity ($k_f$) in the absence of toner particles was also determined. Toner particles were removed from the liquid medium by centrifugation at 10° C. for 1 hour at 7,500 rpm (6,110 relative centrifugal force) in a Jouan MR1822 centrifuge (Winchester, Va.). The supernatant liquid was then carefully decanted, and the conductivity of this liquid was measured using a Scientifica Model 627 conductance meter. The percentage of free phase conductivity relative to the bulk toner conductivity was then determined as 100% ($k_f/k_b$).

Mobility

Toner particle electrophoretic mobility (dynamic mobility) was measured using a Matec MBS-8000 Electrokinetic Sonic Amplitude Analyzer (Matec Applied Sciences, Inc., Hopkinton, Mass.). Unlike electrokinetic measurements based upon microelectro-phoresis, the MBS-8000 instrument has the advantage of requiring no dilution of the toner sample in order to obtain the mobility value. Thus, it was possible to measure toner particle dynamic mobility at solids concentrations actually preferred in printing. The MBS-8000 measures the response of charged particles to high frequency (1.2 MHz) alternating (AC) electric fields. In a high frequency AC electric field, the relative motion between charged toner particles and the surrounding dispersion medium (including counter-ions) generates an ultrasonic wave at the same frequency of the applied electric field. The amplitude of this ultrasonic wave at 1.2 MHz can be measured using a piezoelectric quartz transducer; this electrokinetic sonic amplitude (ESA) is directly proportional to the low field AC electrophoretic mobility of the particles. The particle zeta potential can then be computed by the instrument from the measured dynamic mobility and the known toner particle size, liquid dispersant viscosity, and liquid dielectric constant. Q/M The charge per mass measurement (Q/M) was measured using an apparatus that consists of a conductive metal plate, a glass plate coated with Indium Tin Oxide (ITO), a high voltage power supply, an electrometer, and a personal computer (PC) for data acquisition. A 1% solution of ink was placed between the conductive plate and the ITO coated glass plate. An electrical potential of known polarity and magnitude was applied between the ITO coated glass plate and the metal plate, generating a current flow between the plates and through wires connected to the high voltage power supply. The electrical current was measured 100 times a second for 20 seconds and recorded using the PC. The applied potential causes the charged toner particles to migrate towards the plate (electrode) having opposite polarity to that of the charged toner particles. By controlling the polarity of the voltage applied to the ITO coated glass plate, the toner particles may be made to migrate to that plate.

The ITO coated glass plate was removed from the apparatus and placed in an oven for approximately 1 hour at 160° C. to dry the plated ink completely. After drying, the ITO coated glass plate containing the dried ink film was weighed. The ink was then removed from the ITO coated glass plate using a cloth wipe impregnated with Norpar™ 12, and the clean ITO glass plate was weighed again. The difference in mass between the dry ink coated glass plate and the clean glass plate is taken as the mass of ink particles (m) deposited during the 20 second plating time. The electrical current values were used to obtain the total charge carried by the toner particles (Q) over the 20 seconds of plating time by integrating the area under a plot of current vs. time using a curve-fitting program (e.g. TableCurve 2D from Systat Software Inc.). The charge per mass (Q/m) was then determined by dividing the total charge carried by the toner particles by the dry plated ink mass.

Print Testing

In the following examples, toner was printed onto final image receptors using the following methodology:

A light-sensitive temporary image receptor (organic photoreceptor or "OPC") was charged with a uniform positive charge of approximately 850 volts. The positively charged surface of the OPC was image-wise irradiated with a scanning infrared laser module in order to reduce the charge wherever the laser struck the surface. Typical charge-reduced values were between 50 volts and 100 volts.

A developer apparatus was then utilized to apply the toner particles to the OPC surface. The developer apparatus included the following elements: liquid toner, a conductive rubber developer roller in contact with the OPC, an insulative foam cleaning roller in contact with the developer roller surface, a conductive deposition roller, a conductive metering roller, or "skive roller" in contact with the developer roller, and an insulative foam ink pumping roller. The contact area between the developer roller and the OPC is referred to as the "developing nip." The conductive deposition roller was positioned with its roller axis parallel to the developer roller axis and its surface arranged to be approximately 150 microns from the surface of the developer roller, thereby forming a deposition gap.

During development, the ink-pumping roller supplied liquid ink to the gap between the deposition roller and the developer roller. A toner film was initially plated to the developer roller surface by applying a voltage of approximately 600 volts to the developer roller and applying a voltage of approximately 800 volts to both the deposition and metering rollers. The 200 volt difference between the developer and deposition roller caused the positively charged toner particles to migrate in the deposition nip to the surface of the developer roller. The metering roller, which is biased to approximately 800 volts, removed excess liquid from the developer roller surface.

The surface of the developer roller now contained a uniformly thick layer of toner at approximately 25% (w/w) solids. As this toner layer passed through the developing nip, toner was transferred from the developer roller to the latent image areas. The approximate 500 volt difference between the developer roller and the latent image area caused the positively charged toner particles to develop to the OPC surface. At the exit of the developing nip, the OPC contained a toner image and the developer roller contained a negative of that toner image which was then cleaned from the developer roller surface by the rotating foam cleaning roller.

The developed image on the OPC was subsequently electrostatically transferred to an Intermediate Transfer Belt (ITB) with an electrical bias in the range of −800 to −2000 volts applied to a conductive rubber roller pressing the ITB to the OPC surface. Transfer to the final image receptor was accomplished with electrostatically-assisted offset transfer by forcibly applying a conductive, biased rubber transfer roller behind the image receptor, pressing the imaged ITB between the final image receptor and a grounded, conductive metal transfer backup roller. The transfer roller is typically biased in the range of −1200 to −3000 volts. The image is fixed to the final image receptor using heat and pressure.

Optical Density and Color Purity

To measure optical density and color purity a GRETAG SPM 50 LT meter was used. The meter is made by Gretag Limited, CH-8105 Regensdort, Switzerland. The meter has several different functions through different modes of operations, selected through different buttons and switches. When a function (optical density, for example) is selected, the measuring orifice of the meter is placed on a background, or non-imaged portion of the imaged substrate in order to "zero" it. It is then placed on the designated color patch and the measurement button is activated. The optical densities of the various color components of the color patch (in this case, Cyan (C), Magenta (M), Yellow (Y), and Black (K)) will then displayed on the screen of the meter. The value of each specific component is then used as the optical density for that component of the color patch. For instance, where a color patch is only cyan, the optical density reading may be listed as simply the value on the screen for C. Where the color patch is a combination of colors (such as Blue=Cyan+Magenta), the meter will read the optical density of the cyan that contributes to the blue patch and is expressed as C(B); that same patch would also have a magenta component, expressed as M(B).

Materials

The following abbreviations are used in the examples:

EMA: Ethyl methacrylate (available from Aldrich Chemical Co., Milwaukee, Wis.)

HEMA: 2-Hydroxyethyl methacrylate (available from Aldrich Chemical Co., Milwaukee, Wis.)

TCHMA: Trimethyl cyclohexyl methacrylate (available from Ciba Specialty Chemical Co., Suffolk, Va.)

TMI: Dimethyl-m-isopropenyl benzyl isocyanate (available from CYTEC Industries, West Paterson, N.J.)

V-601: Dimethyl 2,2'-azobisisobutyrate (an initiator available as V-601 from WAKO Chemicals U.S.A., Richmond, Va.)

DBTDL: Dibutyl tin dilaurate (a catalyst available from Aldrich Chemical Co., Milwaukee, Wis.)

Nomenclature

In the following examples, the compositional details of each copolymer will be summarized by ratioing the weight percentages of monomers used to create the copolymer. The grafting site composition is expressed as a weight percentage of the monomers comprising the copolymer or copolymer precursor, as the case may be. For example, a graft stabilizer (precursor to the S portion of the copolymer) is designated TCHMA/HEMA-TMI (97/3–4.7% w/w), and is made by copolymerizing, on a relative basis, 97 parts by weight TCHMA and 3 parts by weight HEMA, and this hydroxy functional polymer was reacted with 4.7 parts by weight of TMI.

Similarly, a graft copolymer organosol designated TCHMA/HEMA-TMI//EMA (97-3–4.7//100% w/w) is made by copolymerizing the designated graft stabilizer (TCHMA/HEMA-TMI (97/3–4.7% w/w)) (S portion or shell) with the designated core monomer EMA (D portion or core) at a specified ratio of D/S (core/shell) determined by the relative weights reported in the examples.

Ink Preparation

Preparation of Copolymer Graft Stabilizer

TABLE 1

| | Graft Stabilizer | Solids | Molecular Weight | |
|---|---|---|---|---|
| Composition # | Compositions (% w/w) | (% w/w) | $M_w$ | $M_w/M_n$ |
| 1 | TCHMA/HEMA-TMI (97/3-4.7%) | 26.20 | 276,950 | 3.15 |
| 2 | TCHMA/HEMA-TMI (97/3-4.7%) | 26.61 | 279,300 | 2.88 |
| 3 | TCHMA/HEMA-TMI (97/3-4.7%) | 26.1 | 267,800 | 2.48 |

Composition 1

A 50 gallon reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with 193 lb of Norpar™ 12, by vacuum. The vacuum was then broken and a flow of 1 CFM of nitrogen applied and the agitation is started at 70 RPM. 66.4 lb of TCHMA was added and the container rinsed with 2.6 lbs of Norpar™ 12. 2.10 lb of 98% (w/w) HEMA was added and the container rinsed with 1.37 lbs of Norpar™ 12. Finally 1.03 lb of V-601 was added and the container rinsed with 0.2 lbs of Norpar™ 12. A full vacuum was then applied for 10 minutes, and then broken by a nitrogen blanket. A second vacuum was pulled for 10 minutes, and then agitation stopped to verify that no bubbles were coming out of the solution. The vacuum was then broken with a nitrogen blanket and a light flow of nitrogen of 1 CFH (cubic foot per hour) was applied. Agitation was resumed at 75 RPM and the mixture was heated to 75° C. and held for 16 hours. The conversion was quantitative.

The mixture was heated to 90° C. and held at that temperature for 1 hour to destroy any residual V-601, and then was cooled back to 70° C. The nitrogen inlet tube was then removed, and 1.06 lb of 95% (w/w) DBTDL was added to the mixture using 1.37 lbs of Norpar™ 12 to rinse container, followed by 3.23 lb of TMI. The TMI was added drop wise over the course of approximately 5 minutes while stirring the reaction mixture and the container was rinsed with 1.4 lbs of Norpar™ 12. The mixture was allowed to react at 70° C. for 6 hours, at which time the conversion was quantitative.

The mixture was then cooled to room temperature. The cooled mixture was a viscous, transparent liquid containing no visible insoluble matter. The percent solids of the liquid mixture was determined to be 26.20% (w/w) using the drying method described above. Subsequent determination of molecular weight was made using the GPC method described above; the copolymer had a $M_w$ of 276,950 and $M_w/M_n$ of 3.15 based on two independent measurements. The product is a copolymer of TCHMA and HEMA containing random side chains of TMI and is designated herein as TCHMA/HEMA-TMI (97/3–4.7% w/w) and can be used to make an organosol.

Composition 2

A 50 gallon reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with 193 lb of Norpar™ 12, by vacuum. The vacuum was then broken and a flow of 1 CFH (cubic foot per hour) of nitrogen applied and the agitation is started at 70 RPM. 66.4 lb of TCHMA was added and the container rinsed with 2.7 lbs of Norpar™ 12. 2.10 lb of 98% (w/w) HEMA was added and the container rinsed with 1.37 lbs of Norpar™ 12. Finally 1.03 lb of V-601 was added and the container rinsed with 0.2 lbs of Norpar™ 12. A full vacuum was then applied for 10 minutes, and then broken by a nitrogen blanket. A second vacuum was pulled for 10 minutes, and then agitation stopped to verify that no bubbles were coming out of the solution. The vacuum was then broken with a nitrogen blanket and a light flow of nitrogen of 1 CFH was applied. Agitation was resumed at 75 RPM and the mixture was heated to 75° C. and held for 16 hours. The conversion was quantitative.

The mixture was heated to 90° C. and held at that temperature for 4 hours to destroy any residual V-601, and then was cooled back to 70° C. The nitrogen inlet tube was then removed, and 1.06 lb of 95% (w/w) DBTDL was added to the mixture using 1.37 lbs of Norpar™ 12 to rinse container, followed by 3.23 lb of TMI. The TMI was added drop wise over the course of approximately 5 minutes while stirring the reaction mixture and the container was rinsed with 1.4 lbs of Norpar™ 12. The mixture was allowed to react at 70° C. for 6 hours, at which time the conversion was quantitative.

The mixture was then cooled to room temperature. The cooled mixture was a viscous, transparent liquid containing no visible insoluble matter. The percent solids of the liquid mixture were determined to be 26.61% (w/w) using the drying method described above. Subsequent determination of molecular weight was made using the GPC method described above; the copolymer had a $M_w$ of 279,300 and $M_w/M_n$ of 2.88 based on two independent measurements. The product is a copolymer of TCHMA and HEMA containing random side chains of TMI and is designated herein as TCHMA/HEMA-TMI (97/3–4.7% w/w) and can be used to make an organosol.

Composition 3

A 50 gallon reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with 195 lb of Norpar™ 12, by vacuum. The vacuum was then broken and a flow of 1 CFH (cubic foot per hour) of nitrogen applied and the agitation is started at 70 RPM. 66.4 lb of TCHMA was added and the container rinsed with 2.7 lbs of Norpar™ 12. 2.10 lb of 98% (w/w) HEMA was added and the container rinsed with 1.37 lbs of Norpar™ 12. Finally 0.86 lb of V-601 was added and the container rinsed with 0.2 lbs of Norpar™ 12. A full vacuum was then applied for 10 minutes, and then broken by a nitrogen blanket. A second vacuum was pulled for 10 minutes, and then agitation stopped to verify that no bubbles were coming out of the solution. The vacuum was then broken with a nitrogen blanket and a light flow of nitrogen of 1 CFH was applied. Agitation was resumed at 75 RPM and the mixture was heated to 75° C. and held for 4 hours. The conversion was quantitative.

The mixture was heated to 100° C. and held at that temperature for 1 hour to destroy any residual V-601, and then was cooled back to 70° C. The nitrogen inlet tube was then removed, and 0.11 lb of 95% (w/w) DBTDL was added to the mixture using 1.37 lbs of Norpar™ 12 to rinse container, followed by 3.23 lb of TMI. The TMI was added drop wise over the course of approximately 5 minutes while stirring the reaction mixture and the container was rinsed with 1.4 lbs of Norpar™ 12. The mixture was allowed to react at 70° C. for 2 hours, at which time the conversion was quantitative.

The mixture was then cooled to room temperature. The cooled mixture was a viscous, transparent liquid containing no visible insoluble matter. The percent solids of the liquid mixture were determined to be 26.1% (w/w) using the drying method described above. Subsequent determination of molecular weight was made using the GPC method described above; the copolymer had a $M_w$ of 267,800 and $M_w/M_n$ of 2.48 based on two independent measurements. The product is a copolymer of TCHMA and HEMA containing random side chains of TMI and is designated herein as TCHMA/HEMA-TMI (97/3–4.7% w/w) and can be used to make an organosol.

Preparations of Organosols

TABLE 2

| Composition Number | Organosol Compositions (% (w/w)) | Avg. Particle Size (μm) | $T_g$ (° C.) |
|---|---|---|---|
| 4 | TCHMA/HEMA-TMI//EMA/EA (97/3-4.7//87/13) | 54.4 | 60.97 |
| 5 | TCHMA/HEMA-TMI//EMA/EA (97/3-4.7//87/13) | 47.10 | 51.83 |
| 6 | TCHMA/HEMA-TMI//EMA (97/3-4.7//100) | 32.60 | 65.66 |

Composition 4

A 560 gallon reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with a mixture of 1522 lb of Norpar™ 12 and 94.9 lb of the graft stabilizer mixture from Composition 1 @ 26.2% (w/w) polymer solids along with an additional 9.5 lb of Norpar™ 12 to rinse the pump. Agitation was then turned on at a rate of 60 RPM, and temperature was check to ensure maintenance at ambient. Next 177 lb of EMA was added along with 28.5 lb Norpar™ 12 for rinsing the pump. 26.4 lb of EA was added with an additional 28 lb of Norpar™ 12 to rinse the pump. Finally 2.05 lb of V-601 was added, along with 9.5 lb of Norpar™ 12 to rinse the container. A vacuum was then applied at 40 torr for 10 minutes, and then broken by a nitrogen blanket. A second vacuum was pulled at 40 torr for 10 minutes, and then agitation stopped to verify that no bubbles were coming out of the solution. The vacuum was then broken with a nitrogen blanket and a light flow of nitrogen of 0.5 CFH (cubic foot per hour) was applied. Agitation of 75 RPM was resumed and the temperature of the reactor was heated to 70° C. and maintained for 16 hours. The conversion was quantitative.

The resulting mixture was stripped of residual monomer by adding 190 lb of n-heptane and 380 lb of Norpar™ 12 and agitation was held at 80 RPM with the batch heated to 95° C. The nitrogen flow was stopped and a vacuum of 126 torr was pulled and held for 10 minutes. The vacuum was then increased to 80, 50, and 31 torr, being held at each level for 10 minutes. Finally, the vacuum was increased to 20 torr and held for 30 minutes. At that point a full vacuum is pulled and 633 lbs of distillate was collected. The vacuum was then broken, and the stripped organosol was cooled to room temperature, yielding an opaque white dispersion.

This organosol is designated TCHMA/HEMA-TMI//EMA/EA (97/3–4.7//87/13% (w/w)). The percent solid of the organosol dispersion after stripping was determined as 13.00% (w/w) by the drying method described above. Subsequent determination of average particles size was made using the light scattering method described above; the organosol had a volume average diameter of 54.4 μm. The glass transition temperature was measured using DSC, as described above. The organosol polymer had a $T_g$ of 60.97° C.

Composition 5

A 560 gallon reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with a mixture of 1522 lb of Norpar™ 12 and 95.2 lb of the graft stabilizer mixture prepared as Composition 2 @ 26.61% (w/w) polymer solids along with an additional 9.5 lb of Norpar™ 12 to rinse the pump. Agitation was then turned on at a rate of 65 RPM, and temperature was check to ensure maintenance at ambient. Next 176 lb of EMA was added along with 28 lb Norpar™ 12 for rinsing the pump. 26.4 lb of EA was added with an additional 26.4 lb of Norpar™ 12 to rinse the pump. Finally 2.05 lb of V-601 was added, along with 9.5 lb of Norpar™ 12 to rinse the container. A vacuum was then applied at 40 torr for 10 minutes, and then broken by a nitrogen blanket. A second vacuum was pulled at 40 torr for 10 minutes, and then agitation stopped to verify that no bubbles were coming out of the solution. The vacuum was then broken with a nitrogen blanket and a light flow of nitrogen of 0.5 CFH (cubic foot per hour) was applied. Agitation of 85 RPM was resumed and the temperature of the reactor was heated to 70° C. and maintained for 16 hours. The conversion was quantitative.

The resulting mixture was stripped of residual monomer by adding 190 lb of n-heptane and 380 lb of Norpar™ 12 to the organosol and the agitation was held at 80 RPM and the batch heated to 95° C. The nitrogen flow was stopped and a vacuum of 126 torr was pulled and held for 10 minutes. The vacuum was then increased to 80, 50, and 31 torr, being held at each level for 10 minutes. Finally, the vacuum was increased to 20 torr and held for 30 minutes. At that point a full vacuum is pulled and 876 lbs of distillate was collected. The vacuum was then broken, and the stripped organosol was cooled to room temperature, yielding an opaque white dispersion.

This organosol is designated TCHMA/HEMA-TMI//EMA/EA (97/3–4.7//87/13% (w/w)). The percent solid of the organosol dispersion after stripping was determined as 10.60% (w/w) using drying method described above. Subsequent determination of average particles size was made using the light scattering method described above; the organosol had a volume average diameter of 47.10 μm. The glass transition temperature was measured using DSC, as described above. The organosol polymer had a $T_g$ of 51.83° C.

Composition 6

A 560 gallon reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with a mixture of 1528 lb of Norpar™ 12 and 125 lb of the graft stabilizer mixture Composition 3 @ 26.1% (w/w) polymer solids along with an additional 9.5 lb of Norpar™ 12 to rinse the pump. Agitation was then turned on at a rate of 65 RPM, and temperature was check to ensure maintenance at ambient. Next 196 lb of EMA was added along with 28.5 lb Norpar™ 12 for rinsing the pump. Finally 2.28 lb of V-601 was added, along with 9.5 lb of Norpar™ 12 to rinse the container. A vacuum was then applied at 40 torr for 10 minutes, and then broken by a nitrogen blanket. A second vacuum was pulled at 40 torr for 10 minutes, and then agitation stopped to verify that no bubbles were coming out of the solution. The vacuum was then broken with a nitrogen blanket and a light flow of nitrogen of 0.5 CFH (cubic foot per hour) was applied. Agitation of 80 RPM was resumed and the temperature of the reactor was heated to 75° C. and maintained for 5 hours. The conversion was quantitative.

The resulting mixture was stripped of residual monomer by adding 190 lb of n-heptane and 380 lb of Norpar™ 12 to the organosol and the agitation was held at 80 RPM and the batch heated to 95° C. The nitrogen flow was stopped and a vacuum of 126 torr was pulled and held for 10 minutes. The vacuum was then increased to 80, 50, and 31 torr, being held at each level for 10 minutes. The vacuum was increased to 20 torr and held for 30 minutes. At that point a full vacuum is pulled and 821 lbs of distillate was collected. Another 190 lb of n-heptane and 380 lb of Norpar™ 12 were added to the organosol. Agitation was held at 80 RPM and the batch heated to 95° C. The nitrogen flow was stopped and a vacuum of 126 torr was pulled and held for 10 minutes. The vacuum was then increased to 80, 50, and 31 torr, being held at each level for 10 minutes. Finally, the vacuum was increased to 20 torr and held for 30 minutes. At that point a full vacuum is pulled and an additional 616 lbs of distillate was collected. The vacuum was then broken, and the stripped organosol was cooled to room temperature, yielding an opaque white dispersion.

This organosol is designated TCHMA/HEMA-TMI//EMA (97/3–4.7//100% (w/w)). The percent solid of the organosol dispersion after stripping was determined as 13.3% (w/w) using drying method described above. Subsequent determination of average particles size was made using the light scattering method described above; the organosol had a volume average diameter of 32.60 μm. The glass transition temperature was measured using DSC, as described above. The organosol polymer had a $T_g$ of 65.66° C.

Preparation of Liquid Toners

Composition 7

1974 g of the above organosol from Composition 4 @ 13.0% (w/w) solids in Norpar™ 12 was combined with 169 g of Norpar™ 12, 45.9 g of Pigment Yellow 138 (available from Clariant Corp., Wilmington Del.), 5.1 g of Pigment Yellow 83 (Sun Chemical Company, Cincinnati, Ohio) and 5.57 g of 27.65% (w/w) Zirconium HEX-CEM solution (OMG Chemical Company, Cleveland, Ohio). This mixture was then milled in a Hockmeyer HSD Immersion Mill (Model HM/1/4, Hockmeyer Equipment Corp., Elizabeth City, N.C.) charged with 472.6 g of 0.8 mm diameter Yttrium Stabilized Ceramic Media (available from Morimura Bros. (USA) Inc., Torrence, Calif.). The mill was operated at 2500 RPM for 270 minutes with water circulating through the jacket of the milling chamber at 45° C.

A 14.8% (w/w) solids toner concentrate exhibited the following properties as determined using the test methods described above:

Volume Mean Particle Size: 2.92 micron
Q/M: 402 μC/g
Bulk Conductivity: 300 picoMhos/cm
Percent Free Phase Conductivity: 2.35%
Dynamic Mobility: 9.46E-11 ($m^2$/Vsec)

Composition 8

2031 g of the above organosol from Composition 4 @ 13.0% (w/w) solids in Norpar™ 12 was combined with 122 g of Norpar™ 12, 44 g of Pigment Blue 15:4 (Sun Chemical Company, Cincinnati, Ohio) and 3.18 g of 27.65% (w/w) Zirconium HEX-CEM solution (OMG Chemical Company, Cleveland, Ohio). This mixture was then milled in a Hockmeyer HSD Immersion Mill (Model HM-1/4, Hockmeyer Equipment Corp., Elizabeth City, N.C.) charged with 472.6 g of 0.8 mm diameter Yttrium Stabilized Ceramic Media (available from Morimura Bros. (USA) Inc., Torrence, Calif.). The mill was operated at 2500 RPM for 160 minutes with hot water circulating through the jacket of the milling chamber at 40° C.

A 14.71% (w/w) solids toner concentrate exhibited the following properties as determined using the test methods described above:

Volume Mean Particle Size: 2.75 micron
Q/M: 243 μC/g
Bulk Conductivity: 242 picoMhos/cm
Percent Free Phase Conductivity: 0.89%
Dynamic Mobility: 6.61E-11 ($m^2$/Vsec)

Composition 9

1974 g of the organosol from Composition 4 @ 13.0% (w/w) solids in Norpar™ 12 was combined with 163 g of Norpar™ 12, 35.7 g Pigment FR4580 (D.I.C), 15.3 g of Pigment RA1087 (Magruder Color Co., Elizabeth, N.J.), and 11.14 g of 27.65% (w/w) Zirconium HEX-CEM solution (OMG Chemical Company, Cleveland, Ohio). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media (available from Morimura Bros. (USA) Inc., Torrence, Calif.). The mill was operated at 2500 RPM for 175 minutes with hot water circulating through the jacket of the milling chamber at 45° C.

A 14.91% (w/w) solids toner concentrate exhibited the following properties as determined using the test methods described above:

Volume Mean Particle Size: 2.99 micron
Q/M: 253 μC/g
Bulk Conductivity: 211 picoMhos/cm
Percent Free Phase Conductivity: 2.91%
Dynamic Mobility: 6.59E-11 ($m^2$ Vsec)

Composition 10

2031 g of the organosol in Composition 4 @ 13.0% (w/w) solids in Norpar™ 12 was combined with 120 g of Norpar™ 12, 44 g of Pigment Black EK8200 (Aztech Company, Tucson), and 5.57 g of 27.65% (w/w) Zirconium HEX-CEM solution (OMG Chemical Company, Cleveland, Ohio). This mixture was then milled in a Hockmeyer HSD Immersion Mill (Model HM-1/4, Hockmeyer Equipment Corp., Elizabeth City, N.C.) charged with 472.6 g of 0.8 mm diameter Yttrium Stabilized Ceramic Media (available from Morimura Bros. (USA) Inc., Torrence, Calif.). The mill was operated at 2000 RPM for 60 minutes with hot water circulating through the jacket of the milling chamber at 80° C. and then for 180 minutes at 45° C.

A 13.90% (w/w) solids toner concentrate exhibited the following properties as determined using the test methods described above:

Volume Mean Particle Size: 2.8 micron
Q/M: 230 μC/g
Bulk Conductivity: 439 picoMhos/cm
Percent Free Phase Conductivity: 3.18%
Dynamic Mobility: 7.66E-11 ($m^2$/Vsec)

Composition 11

14555 g of the organosol prepared in Composition 5 @ 10.60% (w/w) solids in Norpar™ 12 were combined with 164 g of Norpar™ 12, 257 g of Pigment Blue 15:4 (Sun Chemical Company, Cincinnati, Ohio) and 23.25 g of 27.65% (w/w) Zirconium HEX-CEM solution (OMG Chemical Company, Cleveland, Ohio). This mixture was then milled in a Hockmeyer HSD Immersion Mill (Model HM-1, Hockmeyer Equipment Corp. Elizabeth City, N.C.) charged with 4175 g of 0.8 mm diameter Yttrium Stabilized Ceramic Media (available from Morimura Bros. (USA) Inc., Torrence, Calif.). The mill was operated at 2200 RPM for 60 minutes with hot water circulating through the jacket of the milling chamber at 80° C. and an additional 120 minutes at 45° C.

A 12% (w/w) solids toner concentrate exhibited the following properties as determined using the test methods described above:

Volume Mean Particle Size: 2.9 micron

Q/M: 226 μC/g

Bulk Conductivity: 250 picoMhos/cm

Percent Free Phase Conductivity: 0.86%

Dynamic Mobility: 6.73E-11 ($m^2$/Vsec)

Composition 12

117.29 kg of the organosol prepared in Composition 6 @ 13.30% (w/w) solids in Norpar™ 12 were combined with 19.96 kg of Norpar™ 12, 2.6 kg of Pigment Black EK8200 (Aztech Company, Tucson Ariz.) and 146.62 g of 26.60% (w/w) Zirconium HEX-CEM solution (OMG Chemical Company, Cleveland, Ohio). This mixture was then milled in a Hockmeyer HSD Immersion Mill (Model HM-5, Hockmeyer Equipment Corp. Elizabeth City, N.C.) charged with 15 kg of 0.8 mm diameter Yttrium Stabilized Ceramic Media (available from Morimura Bros. (USA) Inc., Torrence, Calif.). The mill was operated at 1364 RPM for 1 minute with hot water circulating through the jacket of the milling chamber at 80° C. and an additional 94 minutes at 45° C.

A 13% (w/w) solids toner concentrate exhibited the following properties as determined using the test methods described above:

Volume Mean Particle Size: 4.68 micron

Q/M: 76 μC/g

Bulk Conductivity: 148 picoMhos/cm

Percent Free Phase Conductivity: 2.15%

EXAMPLES

In the following examples, certain properties of toners are measured and used to determine system parameter settings that effect the formation of flow patterns on the ink layer as it is plated onto the developer roller in systems of the type described above. Table 3 provides toner identification numbers and measurement results for four toners that were used in this experiment for which the following attributes were measured:

1) Ink percent solids (by weight) in the Norpar™ 12 carrier liquid solution
2) Ink conductivity in solution (in units of Pico-mhos per Centimeter)
3) Average diameter of all toner particles in the solution (units are microns)
4) Charge Retention Time (CRT) of the plated ink layer (units are seconds)
5) Ink Particle Charge per Mass (Q/M) in solution (units are micro-coulombs per gram)

TABLE 3

Ink electrostatic properties

| Ink I.D. | Ink % Solids | Ink Cond. (pMho/cm) | Avg. Vol Diam. (μm) | Initial CRT (sec) | INK Particle Q/M (μC/g) |
|---|---|---|---|---|---|
| Composition 7 - Yellow | 14.80 | 300 | 2.9208 | 0.29 | 193 |
| Composition 9 - Magenta | 14.91 | 211 | 2.993 | 0.60 | 148 |
| Composition 8 - Cyan | 14.71 | 242 | 2.750 | 2.6 | 147 |
| Composition 10 - Black | 13.90 | 439 | 2.8210 | 2.2 | 142 |

CRT is related to toner layer charge retention time. It is the only value that cannot be measured in solution and it represents the time required for the toner layer to reduce its total bulk charge from its initial value to 1/e (1/2.71828) of the initial value.

As shown in Table 3, the charge retention times for the yellow and magenta inks are quite short compared to the charge retention times for the cyan and black inks. In fact, flow pattern on the developer roll in these examples was not observed for yellow and magenta inks when the deposit roller voltage was set equal to the skive voltage. For black and cyan, however, flow pattern could be seen under the conditions described.

For the following examples, a testing apparatus having configurations similar to that shown in FIG. 5 were used. Each example defines the apparatus set-up for that particular example (e.g. which rollers were electrically connected and which were not). For each example, the following protocol was carefully followed.

Experimental Protocol

The liquid toner to be tested is thoroughly shaken and put in the development station; then, an electrostatic voltage probe was positioned at the top of the developer roller (as shown in FIG. 5 above) and the motor that powers the developer roller to rotate was then turned on. After 5 seconds, the appropriate biases of various components were then applied to deposit the plated toner layer on the developer roller. After another 10 seconds when the plating became stabilized, the power to the motor was turned off followed by power off to all system bias voltages. The voltage of the toner layer plus the developer roller was then monitored continuously by the electrostatic voltage probe for a total of 90 sec (with the developer roller stopped) to measure the charge relaxation time of the toner layer. The output of the electrostatic voltage probe was then stored in a computer for later analysis.

By appropriate calculation of values according to the above discussion, the voltage of a given toner layer can be determined anywhere in the system when there is at least one measuring point in the system. In particular, the voltage on a toner layer can be determined at the input to the skive element and it is this voltage that is of interest because this voltage must be lower than the skive bias voltage else flow pattern may be produced on the toner layer as it passes under the skive.

Example 1

Deposit Roller Voltage Set to a Constant 200 Volts—Black Ink

For this example, the deposit roller voltage (520, FIG. 5) was set at 200V. The skive (560, FIG. 5) was set at varying voltages, as shown in Table 5, below. The developer roller (510, FIG. 5) voltage for this experiment is 0 volts; therefore, there is an ink layer being plated onto the developer roller in the deposit roller nip. The hardware arrangement for this experiment was that shown in FIG. 5 above, but with a separate power supply for the skive element. The experimental ink for this example was described in Composition 10.

TABLE 5

Skive Voltage vs. Flow Pattern where Deposit Roller = 200 V

| Skive Voltage | Electrostatic Voltage Probe Reading | Calculated Toner Layer Voltage in Skive Nip | Flow Pattern? |
|---|---|---|---|
| 50 | 84.61 | 118.04 | Yes |
| 100 | 102.31 | 126.09 | Yes |
| 150 | 95.92 | 140.78 | Yes |
| 200 | 100.37 | 186.03 | Yes |
| 250 | 102.38 | 198.44 | No |
| 300 | 127.17 | 234.45 | No |
| 350 | 118.56 | 253.97 | No |
| 400 | 127.62 | 283.25 | No |
| 450 | 149.43 | 316.43 | No |
| 500 | 147.08 | 344.59 | No |

In this example, the toner layer split and created flow pattern when the skive voltage was less than or equal to the deposit roller voltage. When the skive voltage was greater than or equal to 250V, the toner paste appeared to be smooth and was free of flow pattern. Thus, this experiment represents the situation described above relative to FIG. 1 of the present invention, for example, in which flow pattern is eliminated when the skive voltage is greater than the deposit roller voltage.

Example 2

Deposit Roller Voltage and Developer Roller Voltage Set to a Constant 0 Volts (Black Ink)

The data in the table below was obtained using the previously described Composition 10 black ink. The developer roller (510, FIG. 5) voltage and the deposit roller (520, FIG. 5) voltage are both set to 0V for this example; therefore, there is no ink layer being plated onto the developer roller in the developer roller/deposit roller nip. The voltage of the skive (560, FIG. 5) varies as shown in Table 6, below.

TABLE 6

Skive Voltage vs. Flow Pattern where the Deposit Roller = 0 V

| Skive Voltage | Toner Layer Voltage in Skive Nip | Flow Pattern? |
|---|---|---|
| 100 | 32.00 | No |
| 150 | 64.05 | No |
| 200 | 95.92 | No |
| 250 | 135.41 | No |
| 300 | 172.45 | No |

In this example, both the deposit roller electrode and developer roller were tied together to a common voltage. Further, since the deposit roller voltage was set to zero volts, the skive was used both as the only plating electrode as well as the excessive carrier squeezing device. The toner layer on the developer roller under all different skive bias voltages (greater than zero) was smooth and free of flow pattern.

Example 3A

Deposit Roller Voltage Set to a Constant 0 Volts—Cyan Ink

The data in the second and third columns of Table 7 below was obtained using the previously described Composition 8 cyan ink. The developer roller (510, FIG. 5) voltage and the deposit roller (520, FIG. 5) voltage are both set to 0V for this example; therefore, there is no ink layer being plated onto the developer roller in the developer roller/deposit roller nip. The voltage of the skive (560, FIG. 5) varies as shown in Table 7, below.

Example 3B

Deposit Roller Electrically Disconnected—Cyan Ink

The data in the fourth and fifth columns of Table 7 below was obtained using the previously described Composition 8 cyan ink. The developer roller (510, FIG. 5) voltage is set to 0V for this example, and the deposit roller (520, FIG. 5) is completely disconnected from any source of power; therefore, there is no ink layer being plated onto the developer roller in the developer roller/deposit roller nip. The voltage of the skive (560, FIG. 5) varies as shown in Table 7, below.

TABLE 7

Flow pattern vs. Skive voltage-Comparison between where Deposit Roller Voltage is linked to Developer Voltage at 0 V and where Deposit Roller is "Floating"

| Skive Voltage | Toner Layer Voltage in Skive Nip where the Deposit and Developer Rollers = 0 V | Flow Pattern? | Toner Layer Voltage in Skive Nip where Deposit Roller is Disconnected and Developer Roller = 0 V | Flow Pattern? |
|---|---|---|---|---|
| 50 | — | — | 7.63 | No |
| 100 | 13.08 | No | 10.91 | No |
| 150 | 24.78 | No | 23.57 | No |
| 200 | 37.94 | No | 37.81 | No |
| 250 | 52.04 | No | 50.46 | No |
| 300 | 68.00 | No | 64.92 | No |
| 350 | 80.63 | No | 77.10 | No |
| 400 | 94.48 | No | 89.97 | No |
| 450 | — | — | 122.72 | No |

In both of Examples 3A and 3B, each skive voltage tested was higher than the 0V at which the developer roller was set. Although the toner layer voltage in the skive nip was measured to be different when the deposit roller was set to 0V (Example 3A) as compared to when it was electrically disconnected (Example 3B) at each skive voltage value, no flow pattern was generated in any of the samples in this example.

Print Testing

In the print testing method described above in the standard test procedures, the deposit roller and the skive element (metering roller) are connected to the same power supply. For this reason, some flow pattern was always generated on the developer roller of the development station for black ink and was sometimes generated on the developer roller for cyan ink. This flow pattern was then propagated through the machine and then to paper. To eliminate the flow pattern in the final prints, the deposit roller was disconnected electrically and the skive element was biased at a higher voltage than the developer roller.

In order to test whether the new development technique would indeed eliminate the flow pattern on the final prints, samples were printing using the original machine settings and then new prints were obtained using the print settings of the present invention. Although the experiments in Examples 1–3B have the developer roller set at 0V for demonstrative purposes, for printing at least a small development voltage is needed to enable the ink layer on the developer roller to transfer to a discharged photoreceptive element.

Table 8 shows that adequate optical densities may be obtained using either the original machine settings or the new invention settings. The method and apparatus of the present invention do not inhibit the performance of "good" inks, as seen in the data for Composition 11. At the same time, the method and apparatus of the present invention improve the performance of inks that would otherwise not perform satisfactorily. The micrographs in FIGS. 6 and 7 below, show the reduction in flow pattern in images printed using the method of this invention for the ink of Composition 12.

TABLE 8

Print densities and flow pattern results for two inks

| | Prototype Printer Settings | | | | |
|---|---|---|---|---|---|
| Ink Composition | Developer Roller | Deposit Roller | Skive (metering) Roller | Print Density | Flow Pattern? |
| Composition 11 | 550 | 750 | 750 | 1.40 | No |
| | 550 | 0 | 900 | 1.37 | No |
| Composition 12 | 550 | 750 | 750 | 1.24 | Yes |
| | 550 | 0 | 900 | 1.25 | No |

Figure 6:
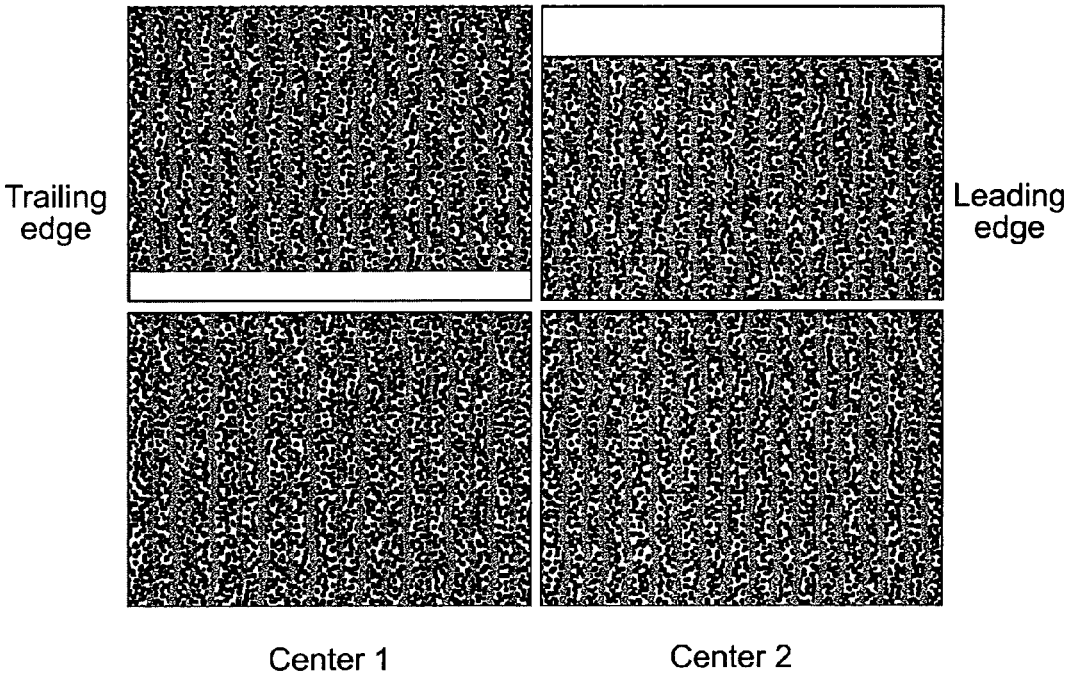
FIG. 6 is a top view of a micrograph of the solid areas in a print showing the flow pattern with the original machine settings.

For the micrograph shown in FIG. 6, a small solid block of black ink was printed using Composition 12 and the original, standard print configuration at the settings in Table 8, above. The flow patterns (rivulet patterns in the solid image) are clearly seen, particularly near the leading and trailing edges of the square block image.

Figure 7:
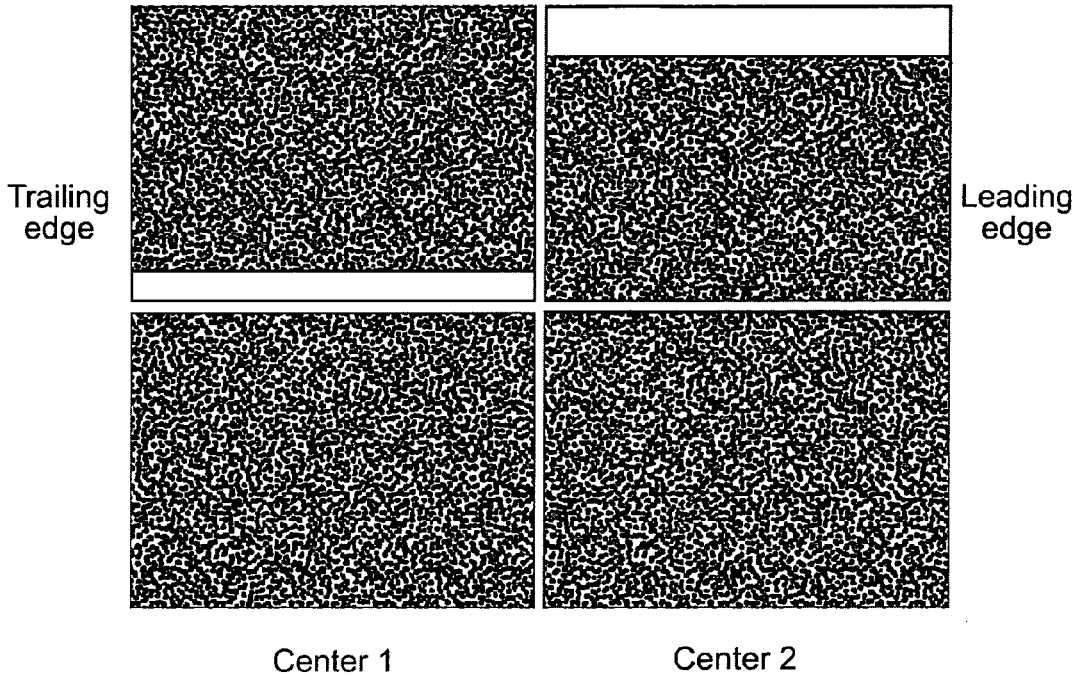
FIG. 7 is a top view of a micrograph of the solid areas in a print showing no flow pattern for the new machine settings.

For the micrograph shown in FIG. 7, a small solid block of black ink was printed using Composition 12 and the print configuration and method of the present invention at the settings in Table 8, above. The same relative areas of the images are represented in the micrographs of FIG. 7 as are seen in FIG. 6. In the micrographs of FIG. 7, flow patterns are no longer observed in any portion of the image.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

We claim:

1. A liquid developer imaging system comprising:

a developing container for receiving a quantity of developing solution;

a sensing system for maintaining a predetermined processing level of developing solution within the developing container;

a developer roller connected to a first power supply source through a voltage-regulating device for biasing the developer roller to a development voltage, wherein the developer roller is positioned to be at least partially submerged in the developing solution at the predetermined processing level;

a skiving element for plating the developing solution onto the developer roller and scraping excess developing solution from the developer roller to a predetermined thickness, wherein the skiving element is connected to the first power supply source for biasing the skiving element to a skiving voltage, wherein the skiving voltage is greater than the development voltage; and a cleaning element for removing residual developing solution from the developer roller.

2. The imaging system of claim 1, wherein the voltage-regulating device is a diode.

3. The imaging system of claim 2, wherein the diode is a zener diode.

4. The imaging system of claim 1, further comprising a deposit roller positioned to be at least partially submerged in the developing solution at the predetermined processing level.

5. The imaging system of claim 1, wherein the skiving element is spaced from the developing solution when the developing solution is at the predetermined processing level.

6. The imaging system of claim 1, in combination with at least one additional liquid developer imaging system within a liquid toner electrophotographic printing system.

7. The imaging system of claim 1, wherein the developer roller comprises an outer surface for developing a toner paste layer having an ink layer voltage, and wherein the skiving voltage is greater than the total of the development voltage and the ink layer voltage.

8. A liquid developer imaging system comprising:

a developing container for receiving a quantity of developing solution;

a sensing system for maintaining a predetermined processing level of developing solution within the developing container;

a developer roller connected to a first power supply source that biases the developer roller to a development voltage, wherein the developer roller is positioned to be at least partially submerged in the developing solution at the predetermined processing level;

a skiving element for plating the developing solution onto the developer roller and scraping excess developing solution from the developer roller to a predetermined thickness, wherein the skiving element is connected to a second power supply source for biasing the skiving element to a skiving voltage, wherein the skiving voltage is greater than the development voltage; and a cleaning element for removing residual developing solution from the developer roller, wherein the developer roller comprises an outer surface for developing a toner paste layer having an ink layer voltage, and wherein the skiving voltage is greater than the total of the development voltage and the ink layer voltage.

9. The imaging system of claim 8, further comprising a deposit roller positioned to be at least partially submerged in the developing solution at the predetermined processing level.

10. A liquid developer imaging system comprising:

a developing container for receiving a quantity of developing solution:

a sensing system for maintaining a predetermined processing level of developing solution within the developing container;

a developer roller connected to a first power supply source that biases the developer roller to a development voltage, wherein the developer roller is positioned to be at least partially submerged in the developing solution at the predetermined processing level;

a skiving element for plating the developing solution onto the developer roller and scraping excess developing solution from the developer roller to a predetermined thickness, wherein the skiving element is connected to a second power supply source for biasing the skiving element to a skiving voltage, wherein the skiving voltage is greater than the development voltage;

a cleaning element for removing residual developing solution from the developer roller; and a deposit roller positioned to be at least partially submerged in the developing solution at the predetermined processing level, wherein the deposit roller is connected to the first power supply source for biasing the deposit roller to a deposition voltage.

11. The imaging system of claim 10, wherein the deposition voltage and the development voltage are the same.

12. The imaging system of claim 10, wherein at least one of the deposition roller and the deposit roller is electrically connected to the first power supply source through a voltage-regulating device for biasing the deposition voltage to be higher than the development voltage.

13. The imaging system of claim 12, wherein the deposition voltage is lower than the skiving voltage.

14. A liquid developer imaging system comprising:

a developing container for receiving a quantity of developing solution;

a sensing system for maintaining a predetermined processing level of developing solution within the developing container;

a developer roller connected to a first power supply source that biases the developer roller to a development voltage, wherein the developer roller is positioned to be at least partially submerged in the developing solution at the predetermined processing level;

a skiving element for plating the developing solution onto the developer roller and scraping excess developing solution from the developer roller to a predetermined thickness, wherein the skiving element is connected to a second power supply source for biasing the skiving element to a skiving voltage, wherein the skiving voltage is greater than the development voltage;

a cleaning element for removing residual developing solution from the developer roller; and a deposit roller positioned to be at least partially submerged in the developing solution at the predetermined processing level, wherein the deposit roller is electrically disconnected from the first and second power supplies.

15. The imaging system of claim 9, wherein the deposit roller is connected to the second power supply source for biasing the deposit roller to a deposition voltage.

16. A liquid developer imaging system comprising:

a developing container for receiving a Quantity of developing solution;

a sensing system for maintaining a predetermined processing level of developing solution within the developing container;

a developer roller connected to a first power supply source that biases the developer roller to a development voltage, wherein the developer roller is positioned to be at least partially submerged in the developing solution at the predetermined processing level;

a skiving element for plating the developing solution onto the developer roller and scraping excess developing solution from the developer roller to a predetermined thickness, wherein the skiving element is connected to a second power supply source for biasing the skiving element to a skiving voltage, wherein the skiving voltage is greater than the development voltage;

a cleaning element for removing residual developing solution from the developer roller; and a deposit roller positioned to be at least partially submerged in the developing solution at the predetermined processing level, wherein the deposit roller is connected to the second power supply source through a voltage-regulating device for biasing the deposit roller to a deposition voltage that is lower than the skiving voltage.

17. The imaging system of claim 16, wherein the deposition voltage is equal to the development voltage.

18. The imaging system of claim 16, wherein the deposition voltage is greater than the development voltage.

19. A method of developing a printed image using a liquid developer imaging system, the method comprising the steps of:

supplying a quantity of developing solution to a developing container to a predetermined fluid level, wherein the developing solution contains a plurality of charged toner particles;

applying a first voltage from a power supply source to a rotating developer roller to bias the developer roller to a development voltage, wherein the developer roller is at least partially submerged in the developing solution within the developing container, and wherein the development voltage is controlled by a voltage-regulating device;

applying the first voltage from the power supply source to a skiving element to bias the skiving element to a skiving voltage that is greater then the development voltage, wherein the developer roller and skiving element are connected to the power supply source;

plating a thickness of the developing solution onto a surface of the developer roller;

removing excess developing solution from the surface of the developer roller to a predetermined thickness;

transferring a portion of the developing solution from the developer roller to latent image areas of a photoreceptor that are in contact with the developer roller; and cleaning the developer roller on each revolution with a cleaning element.

* * * * *